United States Patent [19]

Schwartz

[11] Patent Number: 4,976,652

[45] Date of Patent: Dec. 11, 1990

[54] FLAT HANDCRAFT CONSTRUCTION ELEMENT WITH SLOT AND OPPOSED TABS

[76] Inventor: Idan Schwartz, 76 Zahal St., Petah Tiqwa, Israel

[21] Appl. No.: 434,922

[22] Filed: Nov. 9, 1989

[51] Int. Cl.[5] ..... A63H 33/00; A63H 3/08; A63H 33/16; A63F 9/10

[52] U.S. Cl. ..... 446/488; 446/388; 446/80; 273/157 R

[58] Field of Search ..... 446/488, 487, 387, 388, 446/79, 80, 102, 104, 111, 112, 113, 114, 115, 122, 125; 273/157 R, 155, 156; 52/DIG. 10; 229/84; 434/171, 205

[56] References Cited

U.S. PATENT DOCUMENTS

| | | | |
|---|---|---|---|
| 1,465,284 | 8/1923 | Osenkowski | 229/84 |
| 1,880,130 | 9/1932 | Goldbach | 52/DIG. 10 X |
| 1,890,269 | 12/1932 | Swanson | 446/102 X |
| 1,997,856 | 4/1935 | Cather et al. | 229/84 |
| 2,075,259 | 3/1937 | Battjes | 446/102 X |
| 2,108,451 | 2/1938 | Selezneff | 229/84 |
| 3,234,682 | 2/1966 | Frankl | 446/488 X |
| 3,562,077 | 2/1971 | Raba | 446/125 X |
| 3,666,607 | 5/1972 | Weissman | 52/DIG. 10 X |
| 4,454,678 | 6/1984 | Duvivier | 446/112 |
| 4,874,341 | 10/1989 | Ziegler | 446/109 |

FOREIGN PATENT DOCUMENTS

| | | | |
|---|---|---|---|
| 1547530 | 1/1967 | Fed. Rep. of Germany | 434/171 |
| 1363263 | 5/1964 | France | 273/157 R |
| 1361483 | 7/1974 | United Kingdom | 273/157 R |
| 1401801 | 7/1975 | United Kingdom | 446/113 |

OTHER PUBLICATIONS

Mathematical Models, Cundy & Rollett, 2nd Ed., Oxford University Press, 1961.

One Piece of Paper Grater, Mills, & Boon Ltd., London, 1963 NB 1270 P3G7.

Fun With Paper Folding, Murray & Rigney, Revel Co., 1952 LB 1542 M8 e.2.

A Japanese Paper Folding Classic, Brossman & Brossman, Fontana Lithographers, Washington, D.C., 1961 TT 870 A3.

*Primary Examiner*—Robert A. Hafer
*Assistant Examiner*—D. Neal Muir
*Attorney, Agent, or Firm*—Helfgott & Karas

[57] ABSTRACT

A handcraft construction element comprising a substantially square central engagement portion defining a diagonal slit therethrough and two oppositely disposed triangular integral flaps extending on opposite sides of said engagement portion and separated therefrom by integral hinges, wherein each of said flaps defines an extended tongue adapted to engage said diagonal slit of another such element; and a sheet having a plurality of handcraft construction elements pre-cut for punching out.

9 Claims, 4 Drawing Sheets

Fig. 1.
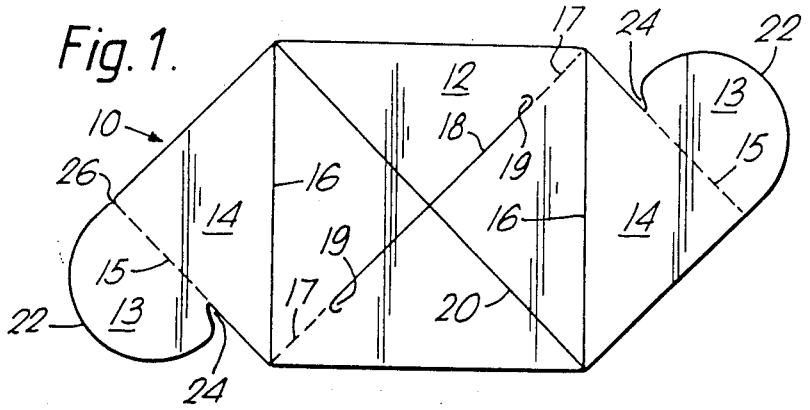
Fig. 3.
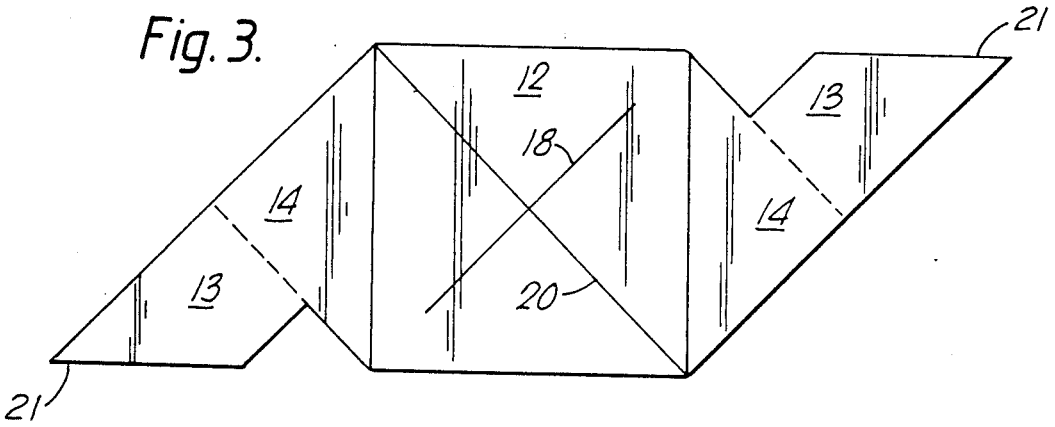
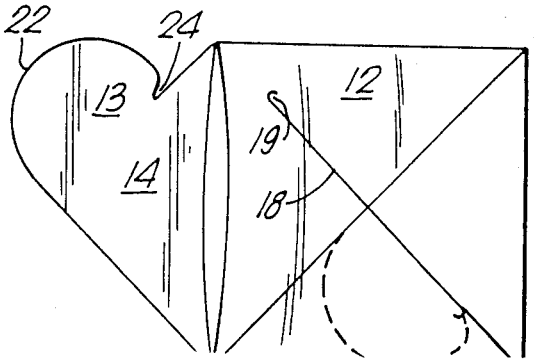
Fig. 4.

Fig.5.
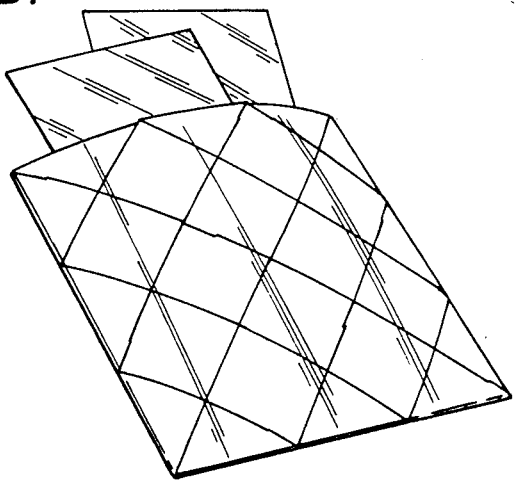
Fig.6.
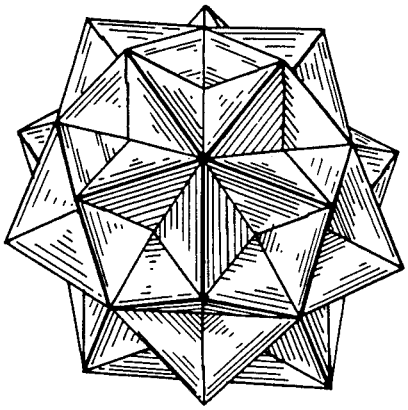
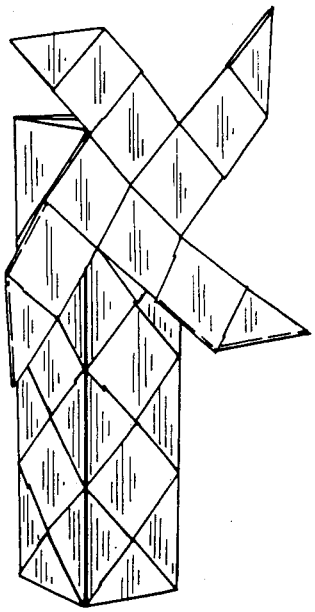
Fig.7.

FLAT HANDCRAFT CONSTRUCTION ELEMENT WITH SLOT AND OPPOSED TABS

FIELD OF THE INVENTION

The present invention relates to handcraft construction elements arranged for interengagement to form two- and three-dimensional structures.

BACKGROUND OF THE INVENTION

Puzzles and other handcraft construction elements of various kinds have long been known. These consist of a variety of elements arranged for interengagement to form two- or three-dimensional structures generally having a continuous picture on the surface thereof.

The most common puzzles consist of a number of unique elements, i.e., each puzzle element is different from the others. There are also known from U.K. Patent No. 1,378,942 flat snap-fit elements of different geometrical shapes defining alternating protrusions and recesses for interlocking to form a variety of three-dimensional objects. These pieces are relatively rigid and form structures having protruding edges extending from the outer surface.

There is also known a constructed paper element in Japanese origami paper folding which comprises a polygonal element defining two pointed flaps and two pockets on one side thereof. A flap of one such element can be inserted into the pocket of a second such element and, in this way, a two- or three-dimensional structure can be built.

These paper elements suffer from several disadvantages. First, since the pockets only appear on one side surface of the element, not both surfaces, coupling of another element thereto can only be accomplished on one side, i.e., only one side is functional. Second, since they are made of paper, the elements are relatively fragile and structures made therefrom are not very stable. Furthermore, they wear very rapidly so are not suitable for building more than a single structure. In other words, a structure cannot be built, taken apart, and the elements reused to build different structure. Third, these elements, by definition, are designed to be created by hand and are not suitable for mass production. And fourth, no locking mechanism is provided, so the elements often inadvertently slide apart from one another during the construction process.

SUMMARY OF THE INVENTION

It is an object of the present invention to provide a handcraft construction element adapted for interlocking with other identical elements, which can be easily and inexpensively mass-produced and which is preferably reversible (i.e. has two functional sides). This element enables the construction of a variety of stable two and three-dimensional structures.

There is thus provided in accordance with the present invention a handcraft construction element, comprising:

a substantially square central engagement portion defining a diagonal slit therethrough, and two oppositely disposed triangular integral flaps extending on opposite sides of said engagement portion and separate therefrom by integral hinges, wherein each of said flaps defines an extended tongue adapted to engage the said diagonal slit of another such element.

According to a preferred embodiment, the flaps and tongues define a notch between them adapted to releasably engage the slit in the central engagement portion of a second handcraft construction element.

There is further provided in accordance with the present invention a sheet defining a plurality of handcraft construction elements as defined hereinbefore, partially pre-cut for punching out of said sheet. Such sheet may be constituted of paper, bristol, rigid plastic or even heavy corrugated cardboard.

BRIEF DESCRIPTION OF THE DRAWINGS

The present invention will be further understood and appreciated from the following detailed description taken in conjunction with the drawings in which:

FIG. 1 is a plan view of a handcraft construction element constructed and operative in accordance with the present invention;

FIG. 3 is a plan view of a handcraft construction element constructed and operative in accordance with an alternate embodiment of the invention;

FIGS. 4 to 7 are perspective illustrations of sample objects which can be formed using the handcraft construction pieces of the present invention.

DETAILED DESCRIPTION OF THE INVENTION

Figure 2:
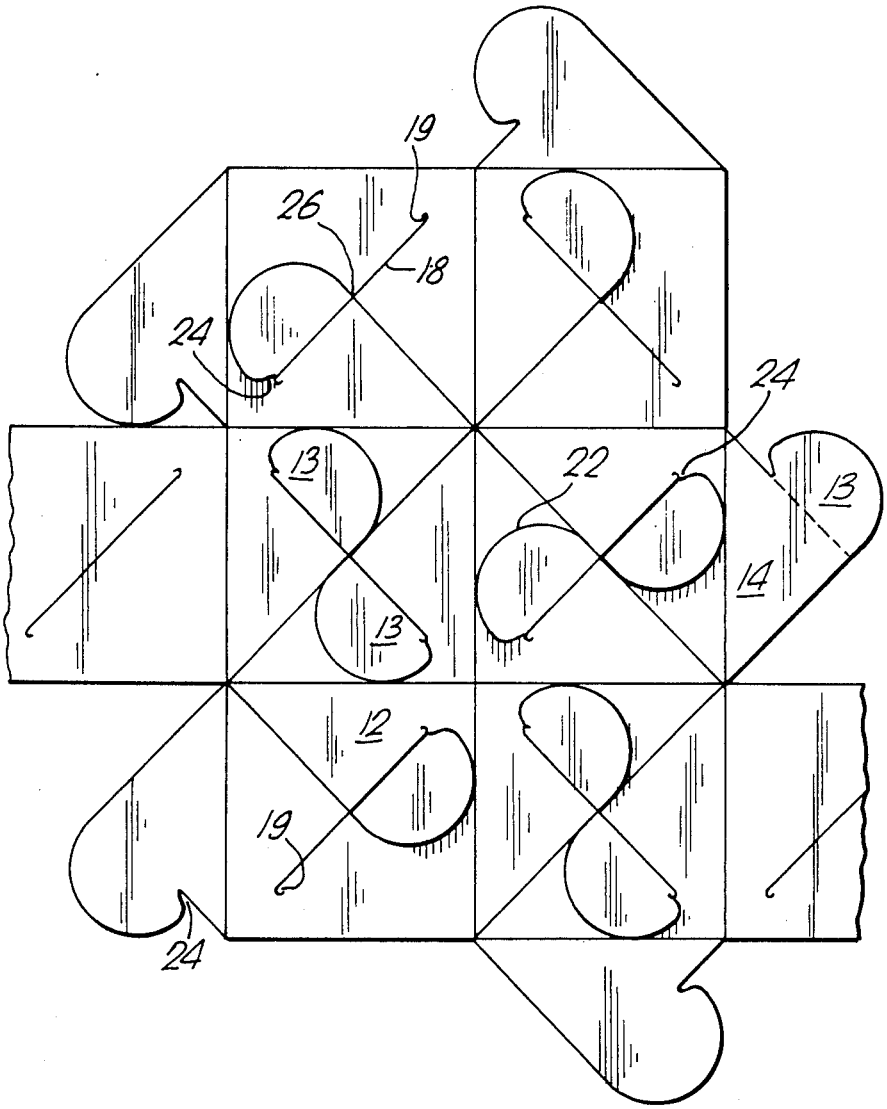
FIG. 2 is a plan view illustration of a plurality of handcraft construction elements of FIG. 1 interengaged with one another.

Referring now to FIG. 1, there is shown in plan view a handcraft construction element constructed and operative in accordance with the present invention, generally designated 10. Handcraft construction element 10 comprises an integral unit of substantially uniform thickness which may be flexible or rigid and may be constructed of paper, bristol, plastic or even heavy corrugated cardboard. For games and toys it is preferable that the construction element be made of plastic, such as polypropylene.

Handcraft construction element 10 defines a substantially square central engagement portion 12 having two oppositely disposed integral triangular flaps 14 with tongues 13 extended from one side of said flap. The flaps 14 are integrally hinged 16 to the central engagement portion 12, thus permitting bending of the flaps 14 in either direction. Preferably, central engagement portion 12 is wider between the flaps 14 than it is high by twice the thickness of the element. This permits folding of a single element to enclose two other elements during construction. Central engagement portion 12 further defines a diagonal slit 18 extending partly thereacross. Slit 18 is preferably about twice the width of the interface 15 between flap 14 and tongue 13, indicated by broken line 15. According to a preferred embodiment, slit 18 terminates in a sharp U-curve 19 at either end thereof. This U-curved slit 19 serves to prevent tearing of the engagement portion and extension of the slit during use. An additional integral hinge 20 may be optionally provided extending diagonally across the central engagement portion at an angle of 90° to the slit 18. Integral hinge 20 serves to permit ease of bending the engagement portion and to facilitate insertion of the tongue 13 into slit 18, as described hereinbelow, when it is desired to construct complex three-dimensional structures.

The interface 15 may also be integrally hinged, as can also be the diagonal extensions 17 of slit 18. These integral hinges 15 and 17 would serve to increase the ease of folding the elements and increase the sharpness of the edges of complex structures.

As illustrated in FIG. 1, the flaps 14 have an extending tongue 13 with rounded edge 22 and notch 24. In operation, as shown in FIG. 2, the tongue 13 of one construction element is inserted into the slit 18 of another handcraft construction element and locked in place by sliding the notch 24 into engagement with the central engagement portion at the curved slit 19. When two handcraft construction elements are coupled to a third, the inserted tongues 13 of flap 14 tend to push against one another, preventing inadvertent removal of one of the flaps from the slit 18. It will be appreciated that tongues 13 may define any number of shapes. In the embodiment of FIG. 1, the tongue 13 has rounded edges 22. This facilitates its insertion into slit 18, particularly when another tongue has already been inserted therein, or when the handcraft construction element is already attached at its other end and, therefore, is limited in its movement. Alternatively, as shown in FIG. 3, tongue 13 may be pointed at 21 or have any other desired shape.

According to another embodiment, the handcraft construction element further defines an indentation 26 between flaps 14 and tongue 13 opposite notch 24, whose diameter is approximately the same as the thickness of the element. The indentation 26 on one handcraft construction element is arranged to engage indentation 26 of a second element when both are inserted into a single slit 18 to prevent wear and to provide additional locking for built structures.

The thickness of the element may vary depending of course on its dimensions. Thus for small constructions, where the central engagement portion is between 2–10 cm in length, the thickness can be from that of paper to about 1 mm or more. For elements made of rigid corrugated cardboard, the thickness may be even up to about 20 mm.

Referring now to FIGS. 4–7, there are shown, by way of example only, a sample of the sorts of structures which can be formed by inter-engagement of the handcraft construction elements of the present invention.

FIG. 4 is a purse, suitable for carrying coins or keys and the like, comprising two handcraft construction pieces engaged with one another, while one piece lies perpendicular to the other.

FIG. 5 is a larger envelope made of the construction elements of the invention.

FIG. 6 shows a geometric three-dimensional structure constructed of a plurality of interlocking handcraft construction elements. When made with transparent material, this object can be used as lampshade.

FIG. 7 illustrates a windmill constructed with the novel construction elements.

Figure 8:
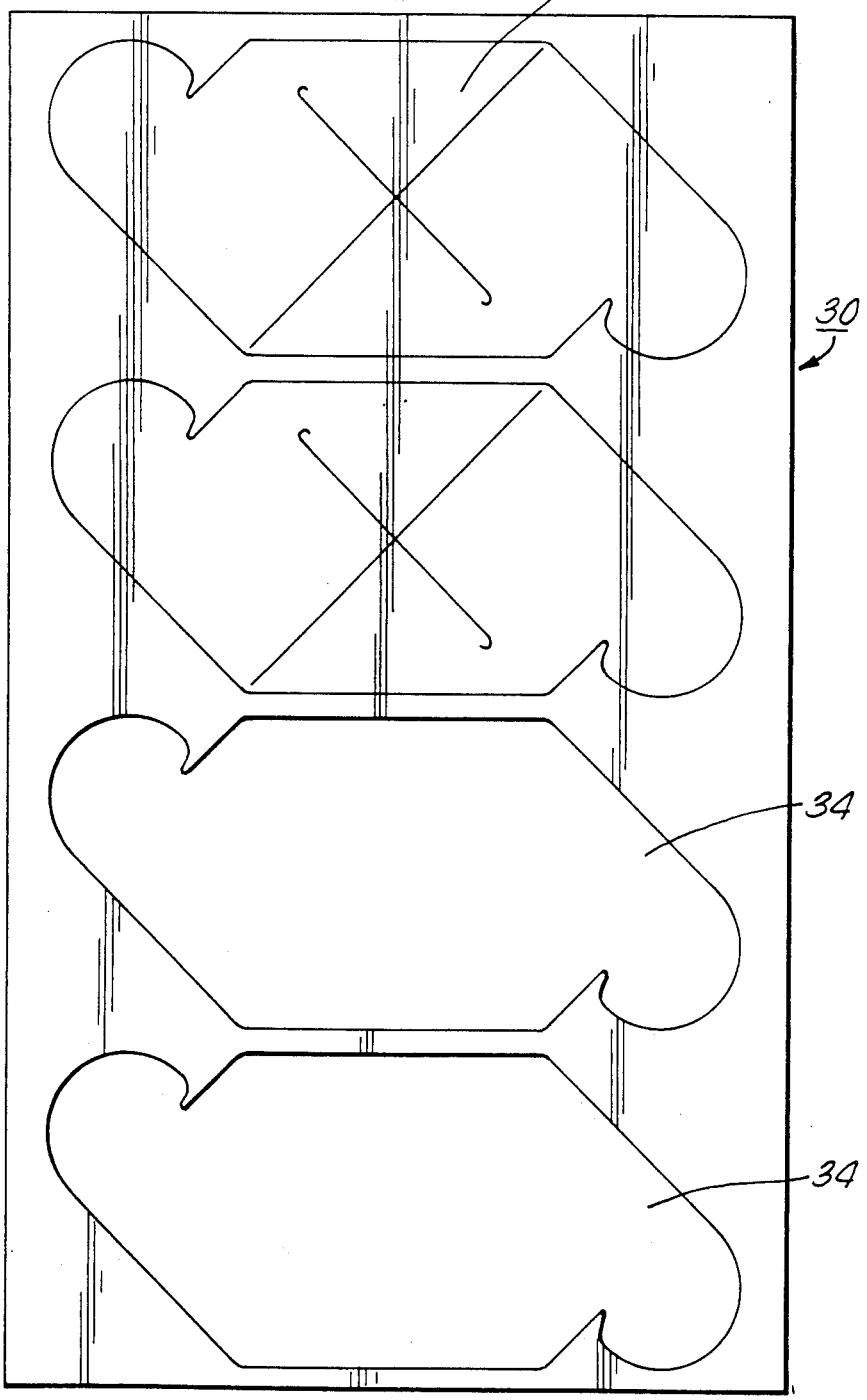
FIG. 8 is a plan view of a plastic sheet incorporating a plurality of handcraft construction elements in accordance with another embodiment of the invention.

Referring now to FIG. 8, there is shown a sheet 30 of material, made of plastic, incorporating a plurality of pre-cut handcraft construction elements 32, as described hereinabove. Two such elements 34 have already been punched out. Sheet 30 is adapted for ease of storage and marketing of the elements and is arranged for snap-out removal of the elements by the user.

The elements of this invention may also be used to construct larger structures when rigid light-weight material is used. Thus, light-weight sheds or booths of two meters or more in height can be assembled using elements according to this invention made, for example, from strong corrugated cardboard.

It will be appreciated by those skilled in the art that the present invention is not limited to what has been shown and described hereinbefore by way of example.

What is claimed:

1. A handcraft construction element comprising:

a substantially square central engagement portion defining a diagonal slit therethrough, and two oppositely disposed triangular integral flaps extending on opposite sides of said engagement portion and separated therefrom by integral hinges, wherein each of said flaps defines an extended tongue adapted to engage said diagonal slit of another such element.

2. A handcraft construction element as in claim 1, wherein the flaps and tongues define a notch between them adapted to releasably engage the slit in the central engagement portion of a second handcraft construction element.

3. A handcraft construction element as in claim 1, wherein the central engagement portion is wider along the axis traversing the flaps than along its height by twice the thickness of the element.

4. A handcraft construction element as in claim 1, wherein the slit extends only partially along the diagonal of the central engagement portion and terminates at both ends in a U-shape.

5. A handcraft construction element as in claim 4, wherein the diagonal slit is about twice the width of the face between the said flap and its tongue.

6. A handcraft construction element according to claim 1, wherein each of said flap and tongue defines a notch at their interface arranged to releasably engage the slit in the engagement portion of a second handcraft construction element.

7. A handcraft construction element according to claim 1, wherein each of said flap and tongue further comprises an indentation disposed opposite said notch, the indentation having a diameter approximately equal to the thickness of the handcraft construction element.

8. A handcraft construction element according to claim 1, further comprising an integral hinge extending across said central engagement portion perpendicular to said slit.

9. A set of handcraft construction elements comprising a sheet defining a plurality of handcraft construction elements according to claim 1 pre-cut for punching out of said sheet.

* * * * *